US007954545B2

(12) United States Patent
Hearn et al.

(10) Patent No.: US 7,954,545 B2
(45) Date of Patent: Jun. 7, 2011

(54) PLUNGER LIFT SYSTEM FOR WELL

(75) Inventors: William Hearn, Cypress, TX (US); Todd Chretien, Lafayette, LA (US)

(73) Assignee: Weatherford/Lamb, Inc., Houston, TX (US)

( * ) Notice: Subject to any disclaimer, the term of this patent is extended or adjusted under 35 U.S.C. 154(b) by 384 days.

(21) Appl. No.: 12/020,366

(22) Filed: Jan. 25, 2008

(65) Prior Publication Data

US 2009/0188673 A1 Jul. 30, 2009

(51) Int. Cl.
*E21B 43/00* (2006.01)

(52) U.S. Cl. ..... 166/68; 166/105; 166/332.8; 166/370; 166/372; 417/56; 417/60

(58) Field of Classification Search ..... 166/68, 166/370, 372, 369, 105, 332.8; 417/56, 57, 417/60, 555.2
See application file for complete search history.

(56) References Cited

U.S. PATENT DOCUMENTS

| | | | | |
|---|---|---|---|---|
| 1,932,495 | A | 10/1933 | VVatters | |
| 3,020,852 | A | 2/1962 | Roach et al. | |
| 3,195,523 | A * | 7/1965 | Lyles | 417/60 |
| 3,351,021 | A * | 11/1967 | Moore, Jr. | 417/57 |
| 3,786,864 | A * | 1/1974 | Segelhorst | 166/187 |
| 5,707,214 | A | 1/1998 | Schmidt | |
| 5,743,717 | A | 4/1998 | Schmidt | |
| 6,874,577 | B2 | 4/2005 | Abbott et al. | |
| 2003/0047316 | A1 | 3/2003 | Bosley | |
| 2005/0241819 | A1 * | 11/2005 | Victor | 166/68 |
| 2006/0113072 | A1 | 6/2006 | Lee | |

FOREIGN PATENT DOCUMENTS

WO 2006032145 A1 3/2006

OTHER PUBLICATIONS

Product Information Sheet; "FlowSafe(TM) WR Wireline-Retrievable Safety Valve;" BJ Services Company; Sep. 14, 2006; 1 page.
Product Information Sheet; "FlowSafe(TM) TR Tubing Retrievable Safety Valve;" BJ Services Company, Dec. 11, 2006; 2 pages.
Product Information Sheet; "Bottomhole Double-Bumper Springs;" Weatherford International Ltd.; 2006; 1 page.
Product Information Sheet; "Combination Plunger;" Weatherford International Ltd.; 2005; 1 page.

(Continued)

*Primary Examiner* — Kenneth Thompson
*Assistant Examiner* — Sean Andrish
(74) *Attorney, Agent, or Firm* — Wong, Cabello, Lutsch, Rutherford & Brucculeri, LLP

(57) ABSTRACT

A plunger lift system has a bumper and a landing positioned in tubing below a safety valve of a well. A plunger moving between the bumper and landing lifts columns of liquid above the plunger when pushed by downhole pressure. A valve on the plunger's housing is movable between open and closed positions to either permit or prevent flow through the plunger. When the plunger engages the landing, a striker rod on the landing opens the valve permitting fluid communication through the plunger to a sales line at the surface. The valve is biased to the closed position to prevent fluid communication through the plunger. When the plunger is disengaged from the striker rod, the valve closes so that application of downhole pressure can again move the plunger uphole. A controller cycles the plunger between the bumper and the landing by controlling fluid flow in the well.

31 Claims, 16 Drawing Sheets

OTHER PUBLICATIONS

Product Information Catalog; "Safety Valves;" Weatherford International Ltd.; 2005; 24 pages.
Product Information Sheet; "T-Pad Plunger;" Weatherford International Ltd.; 2005; 1 page.
Product Information Sheet; "Spiral Plunger;" Weatherford International Ltd.; 2005; 1 page.
Product Information Sheet; "MP-1 Standing Valve;" Weatherford International Ltd.; 2005; 2 pages.
Product Information Sheet; "CEO(TM) Three Plunger-Lift Controller;" Weatherford International Ltd.; 2005; 2 pages.
Product Information Sheet; "Fixed-Brush Plunter;" Weatherford International Ltd.; 2005; 1 page.
Examination Report in counterpart Canadian Application No. 2,651,083, dated Mar. 12, 2010.
European Search Report for counterpart application No. EP 09 25 0200, dated Jan. 18, 2011.

* cited by examiner

PLUNGER LIFT SYSTEM FOR WELL

BACKGROUND

Liquid buildup can occur in aging production wells and can reduce the well's productivity. To handle the buildup, operators may use beam lift pumps or other remedial techniques, such as venting or "blowing down" the well to atmospheric pressure. These common techniques can cause gas loss. Moreover, blowing down a well can produce undesirable methane emissions. In contrast to these techniques, operators can use a plunger lift system, which reduces gas losses and improves well productivity.

A prior art plunger lift system 100 as illustrated in FIG. 1A has a plunger 110 and a bottom hole bumper 120 positioned in tubing 14 within well casing 12. At the wellhead 10, the system 100 has a lubricator/catcher 130 and controller 140. In operation, the plunger 110 initially rests on the bottomhole bumper 120 at the base of the well. As gas is produced to a sales line 150, liquids may accumulate in the wellbore, creating back-pressure that can slow gas production through the sales line 150. Using sensors, the controller 140 operates a valve at the wellhead 10 to regulate the buildup of gas in the casing 12.

Sensing the slowing gas production, the controller 140 shuts-in the well at the wellhead 10 to increase pressure in the well as a high-pressure gas accumulates in the annulus between the casing 12 and tubing 14. When a sufficient volume of gas and pressure are reached, the gas pushes the plunger 110 and the liquid load above it to the surface so that the plunger 110 essentially acts as a piston between liquid and gas in the tubing 14. As shown in FIG. 1B, the plunger 110 can have a solid or semi-hollow body, and the plunger 110 can have spirals, fixed brushes, or pads on the outside of the body for engaging the tubing 14.

Eventually, the gas pressure buildup pushes the plunger 110 upward to the lubricator/catcher 130 at the wellhead 10. The column of fluid above the moving plunger 110 likewise moves up the tubing 14 to the wellhead 10 so that the liquid load can be removed from the well. As the plunger 110 rises, for example, the controller 140 allows gas and accumulated liquids above the plunger 110 to flow through upper and lower outlets 152 and 154. The lubricator/catcher 130 captures the plunger 110 when it arrives at the surface, and the gas that lifted the plunger 110 flows through the lower outlet 154 to the sales line 150. Once the gas flow stabilizes, the controller 140 shuts-in the well and releases the plunger 110, which drops back downhole to the bumper 120. Ultimately, the cycle repeats itself.

To ensure that a well is not able to flow uncontrolled, some wellbores require a downhole safety valve 20 that closes when flow and pressure exceed acceptable limits or when damage occurs to the surface equipment in an emergency. Some safety valves installed in production tubing 14 are tubing retrievable, while other safety valves are wireline retrievable. The downhole safety valves, such as flapper valves, can prevent blow-outs caused by an excessive increase of flow through the wellbore or wellhead damage. Because the plunger 110 travels along the tubing 14 between the bumper 120 at the base of the wellbore and the catcher 130 at the surface, the plunger 110 must travel through the safety valve 20. As expected, the plunger 110 must be designed to fit through the decreased passage within the safety valve 20 and not damage or interfere with the safety valve's operation.

DETAILED DESCRIPTION

Figure 1A:
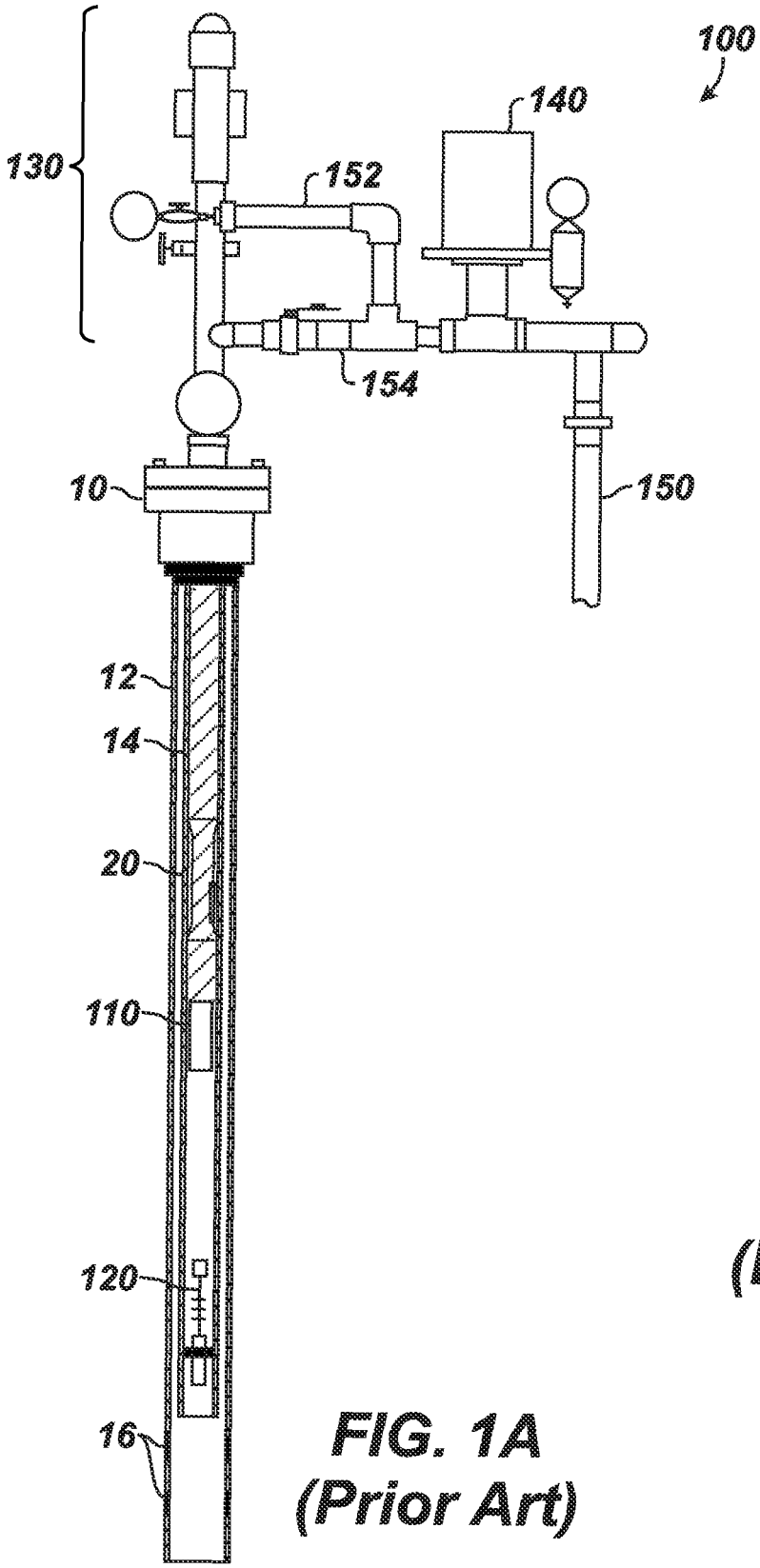
FIG. 1A (Prior Art)
FIG. 1A illustrates a plunger lift system according to the prior art.
Figure 1B:
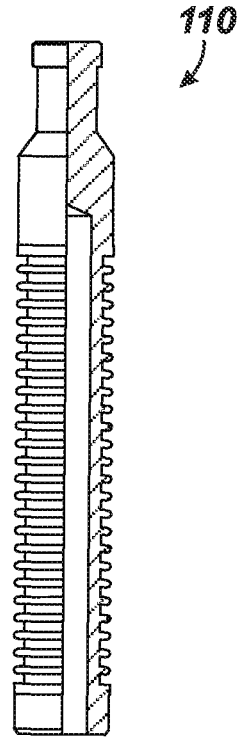
FIG. 1B (Prior Art)
FIG. 1B illustrates a plunger according to the prior art.
Figure 2:
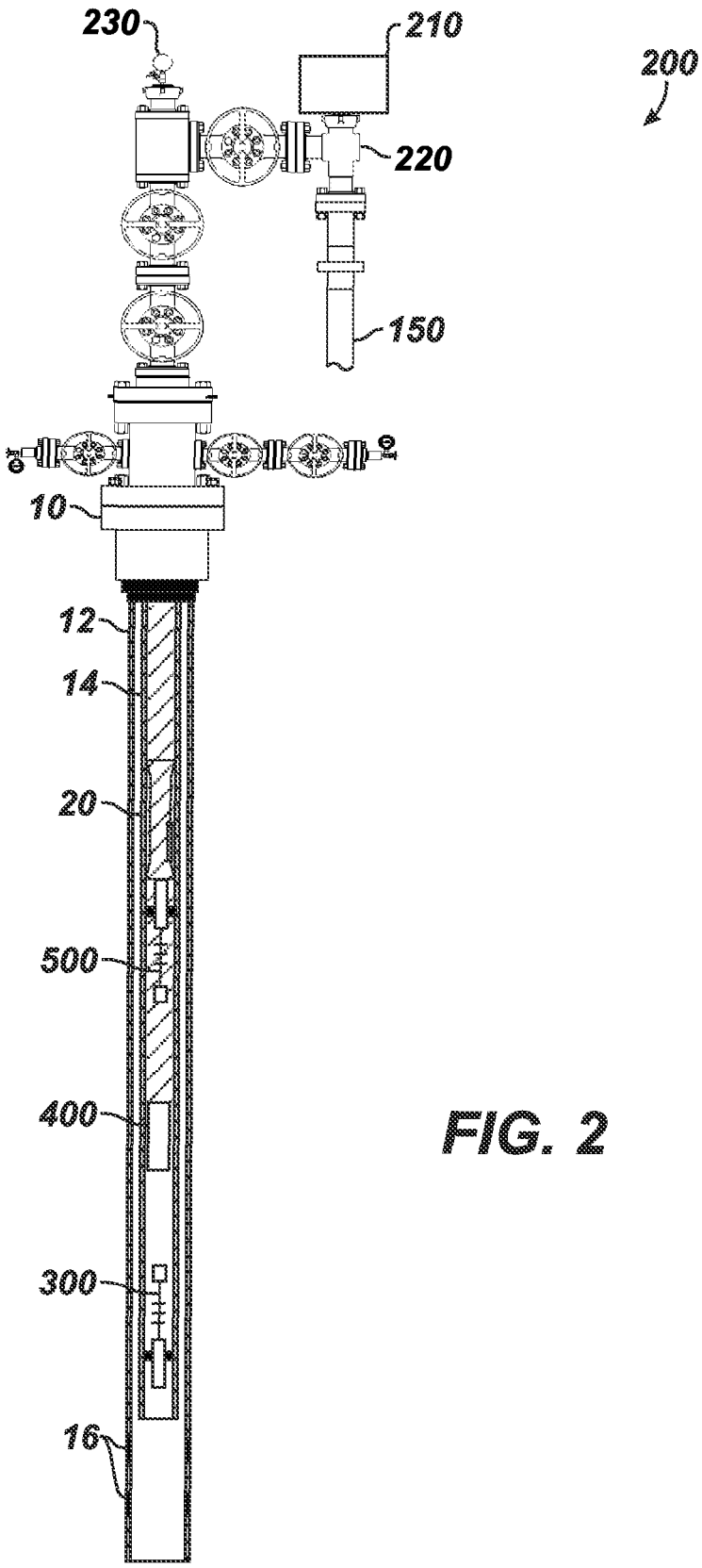
FIG. 2 illustrates a plunger lift system according to one embodiment of the present disclosure.

A plunger lift system 200 illustrated in FIG. 2 has a lower bumper assembly 300, a plunger 400, and an upper landing assembly 500. As opposed to conventional plunger lift systems in the prior art, the plunger lift system 200 does not use a lubricator/catcher with the control system at the surface wellhead. Instead, the system 200 includes a controller 210, a valve 220, and sensors 230 at the surface but does not have the conventional lubricator/catcher. Instead, the system 200 uses the upper landing assembly 500 disposed in the tubing 14 below the safety valve 20 to engage the plunger 400.

As further opposed to conventional systems, the plunger 400 in the disclosed system 200 does not pass through the safety valve 20 in the wellbore. Rather, the bumper assembly 300, plunger 400, and landing assembly 500 position and operate below the safety valve 20, and the plunger 400 travels between the assemblies 300 and 500 without passing through the safety valve 20. Yet, the plunger 400 traveling between the assemblies 300 and 500 still acts as a piston between liquid and gas in the tubing 14 and lifts fluid columns above the plunger 400 as its moves up the well tubing 14.

In one embodiment, the plunger 400 can be any conventional plunger having either a semi-hollow or solid body. In addition, the plunger 400 can have pads, brushes, grooves, elastomer, or other feature to produce a pressure differential across the plunger and to allow upward pressure to lift the plunger from the bottomhole bumper assembly 300 to the landing assembly 500. Such a plunger 400 can resemble the plunger of FIG. 2 or any other conventional plunger. In other embodiments, the plunger 400 includes a hollow housing having a valve to control flow through the plunger 400 and having a pressure differential feature (e.g., pads, brushes, grooves, etc.) on the outside of the housing. Plunger embodiments having a hollow housing and a valve are discussed below with reference to FIGS. 4, 13, 14, and 16, for example.

When lifted, the plunger 400 lifts the fluid column above it until the plunger 400 eventually reaches the upper landing assembly 500 below the safety valve 20. Once reached, the landing assembly 500 stops further upward movement of the plunger 400, and continued upward flow will tend to maintain the plunger 400 in this upward position. If the plunger 400 has a solid or semi-hollow body, the upward flow in the tubing 14 can pass through the surrounding annulus because the pressure differential feature (e.g., pads, brushes, grooves, or the like) on the outside of the plunger 400 does not produce a positive seal. If the plunger 400 has a hollow housing and a valve as in other embodiments, then the upward flow is allowed to flow through the plunger 400 as described later in this disclosure. At some point as the upward flow wanes, the controller 210 monitoring the flow will shut-in the well, allowing the plunger 400 to fall back to the bottomhole bumper assembly 300. One suitable controller 210 for use with the disclosed system 200 includes the CEO™ Plunger Lift Controller series from Weatherford, Inc.

Figure 3A:
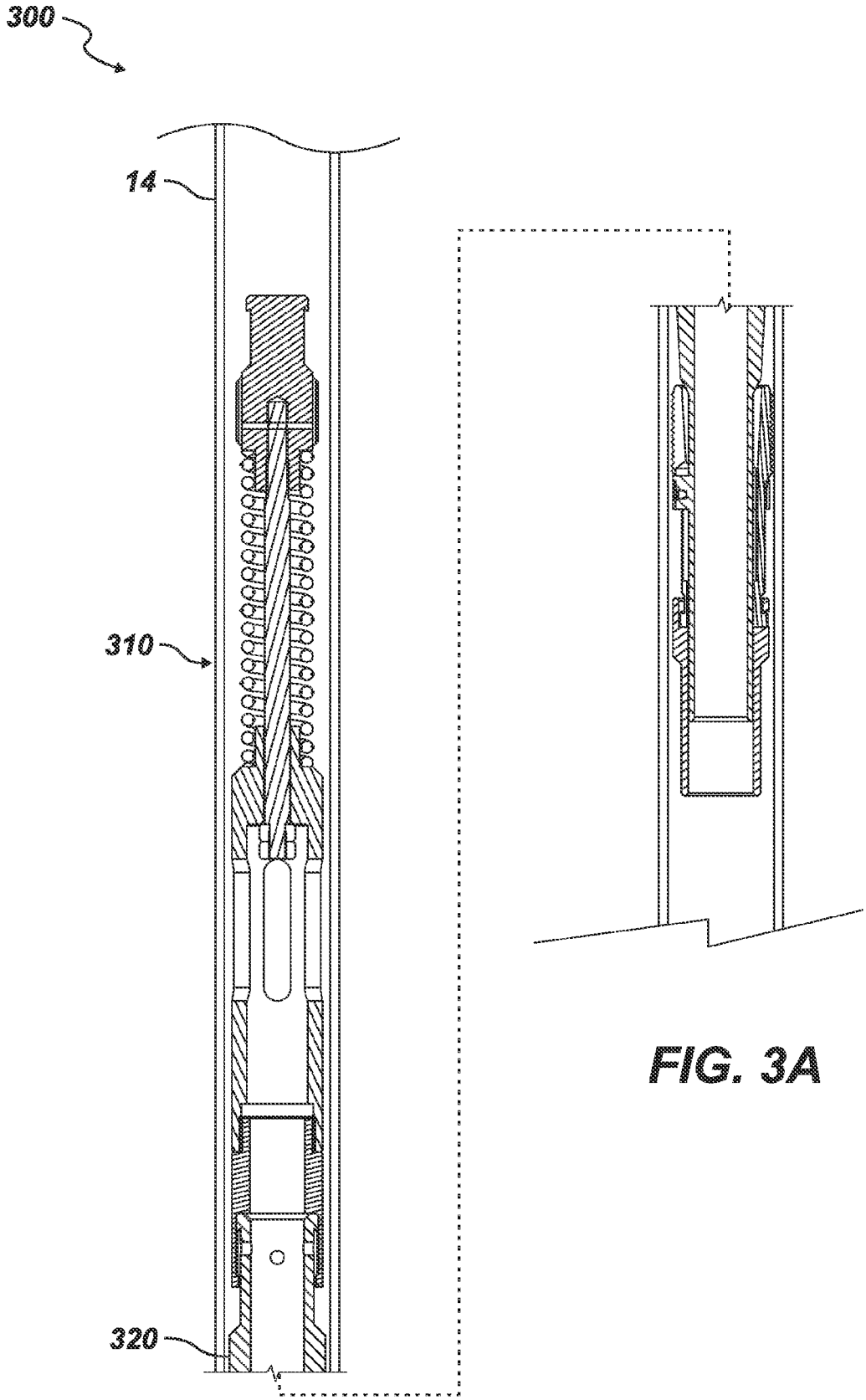
FIG. 3A illustrates a cross-sectional view of a lower bumper assembly of the system in FIG. 2.
Figure 3B:
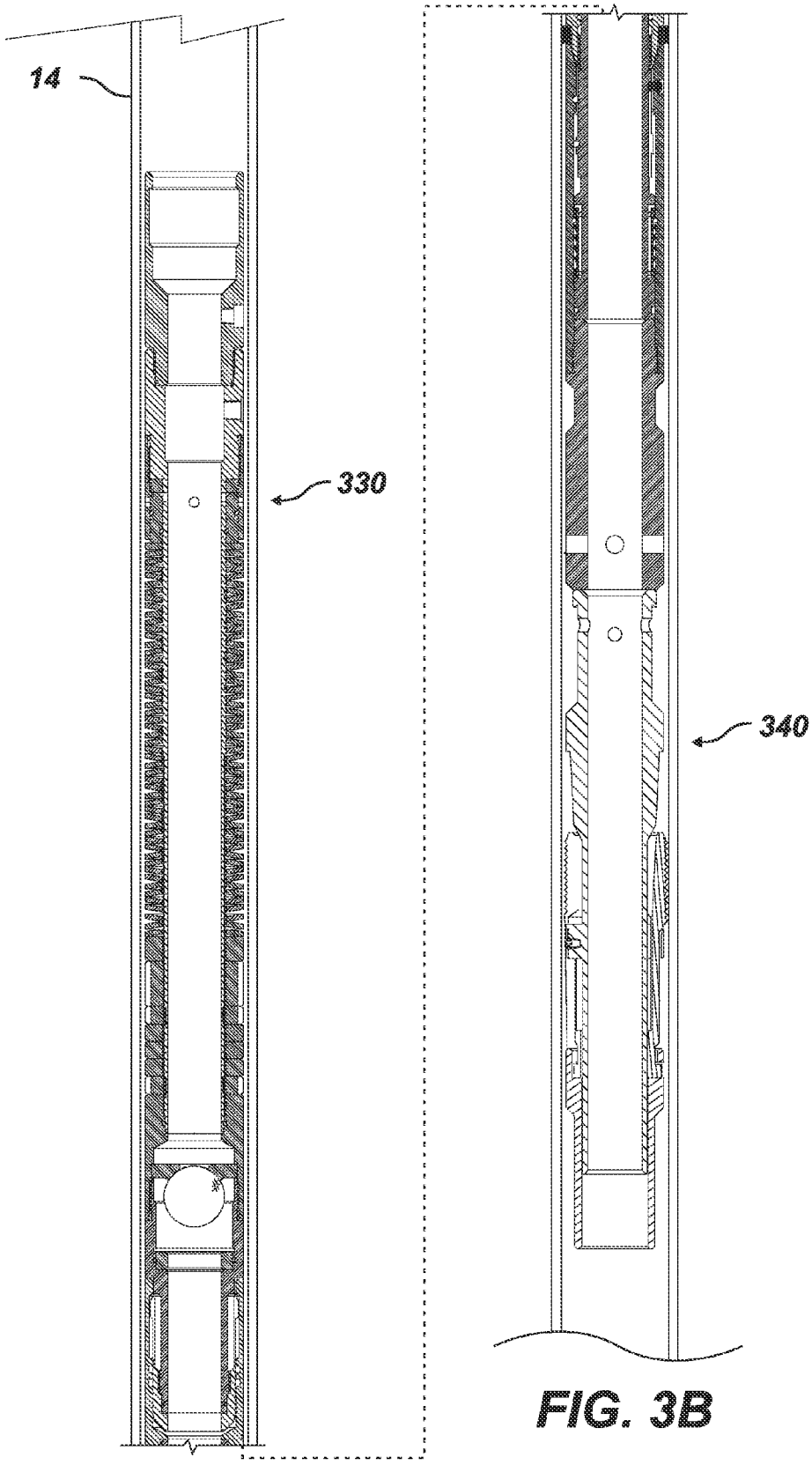
FIG. 3B illustrates a cross-sectional view of additional components of the lower assembly of the system in FIG. 2.

With the understanding of the plunger lift system 200 provided above, discussion now turns to further details of the various components of the system 200, starting with the bottomhole bumper assembly 300. As shown in detail in FIGS. 3A-3B, the bottomhole bumper assembly 300 can be a double bumper spring assembly, such as available from Weatherford, Inc., or it can be any conventional bumper spring assembly. Briefly, the assembly 300 installs in the tubing 14 using wireline procedures and positions at a pre-determined depth in relation to casing perforations 16. As shown in FIG. 3A-3B, the assembly 300 has a biased bumper rod 310 supported on a tubing stop 320. The assembly 300 can also have a standing valve 330 supported on a tubing stop 340 further down the tubing 14, as shown in FIG. 3B.

Figure 6:
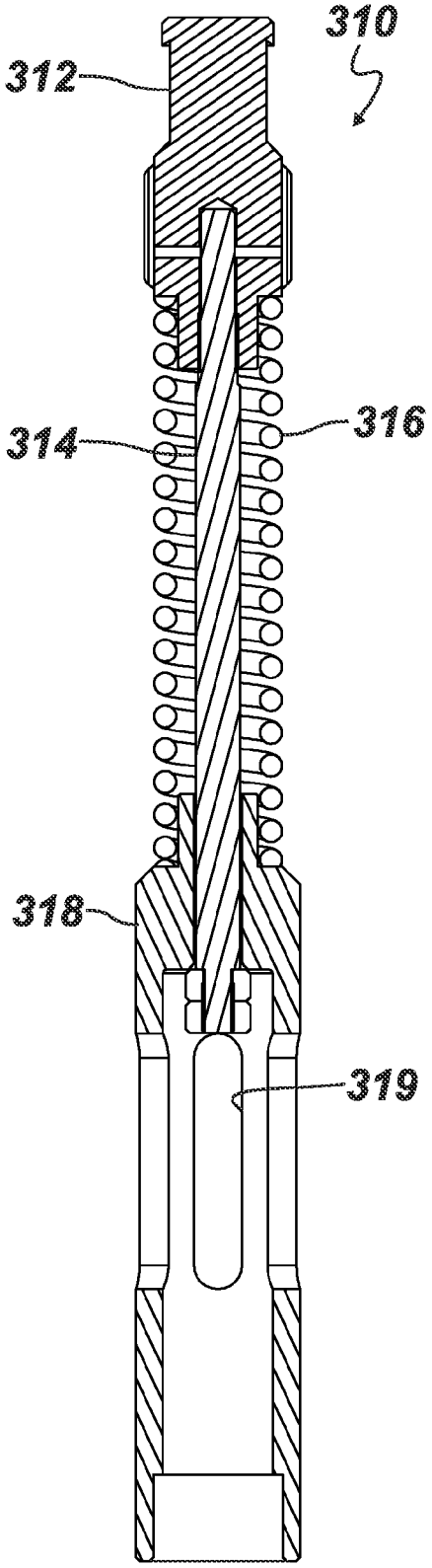
FIG. 6 illustrates a cross-sectional detail of the lower bumper assembly in FIG. 3A.

In the detail of FIG. 6, the biased bumper rod 310 has a strike end 312 and a rod 314. The end 312 attaches to the rod 314 and is biased by a spring 316. The rod 314, on the other hand, passes through a connector end 318 defining openings 319 for passage of liquid and gas from the lower tubing stop (i.e., 320 in FIG. 3A).

Figure 5A:
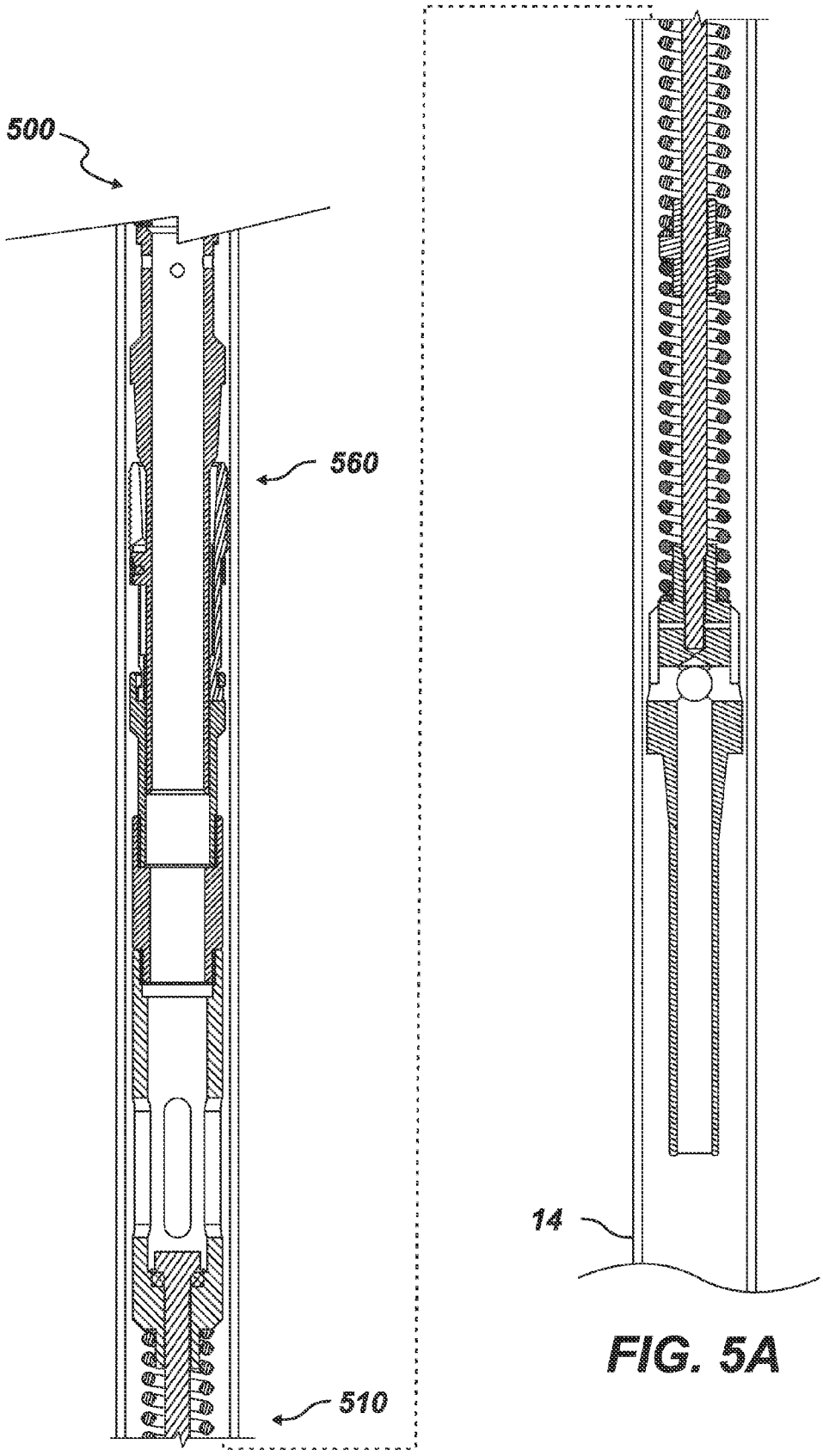
FIG. 5A illustrates a cross-sectional view of an upper landing assembly of the system in FIG. 2.
Figure 5B:
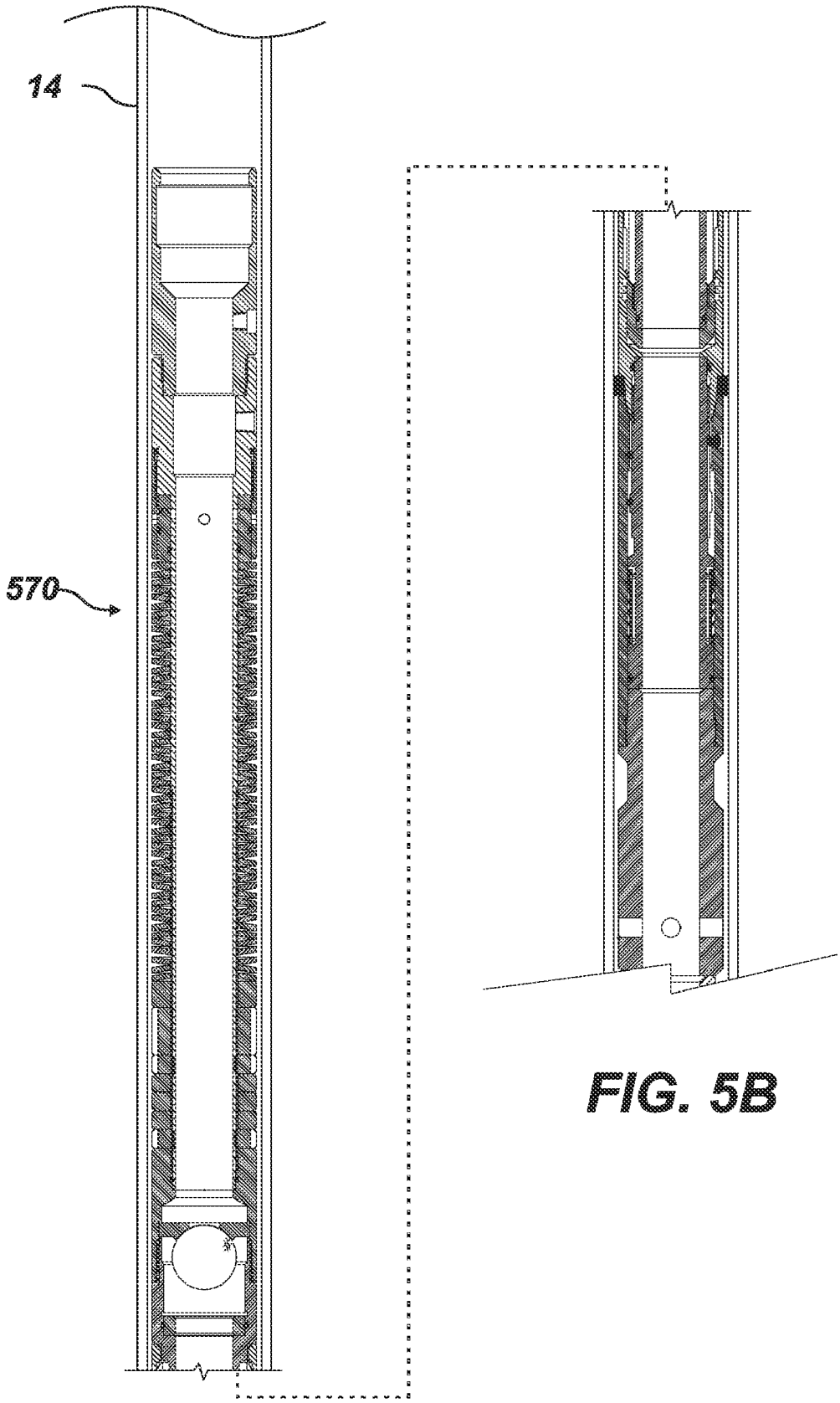
FIG. 5B illustrates a cross-sectional view of additional components of the upper assembly of the system in FIG. 2.

Now turning to the upper landing assembly 500 shown in detail in FIGS. 5A-5B, a striker assembly 510 is supported by a tubing stop 560. The assembly 500 can also have a standing valve 570 supported by the stop 560 further up the tubing 14. Such a standing valve 570 can prevent uphole fluid from flowing back downhole, for example, if a plunger lift is unsuccessful.

Figure 8:
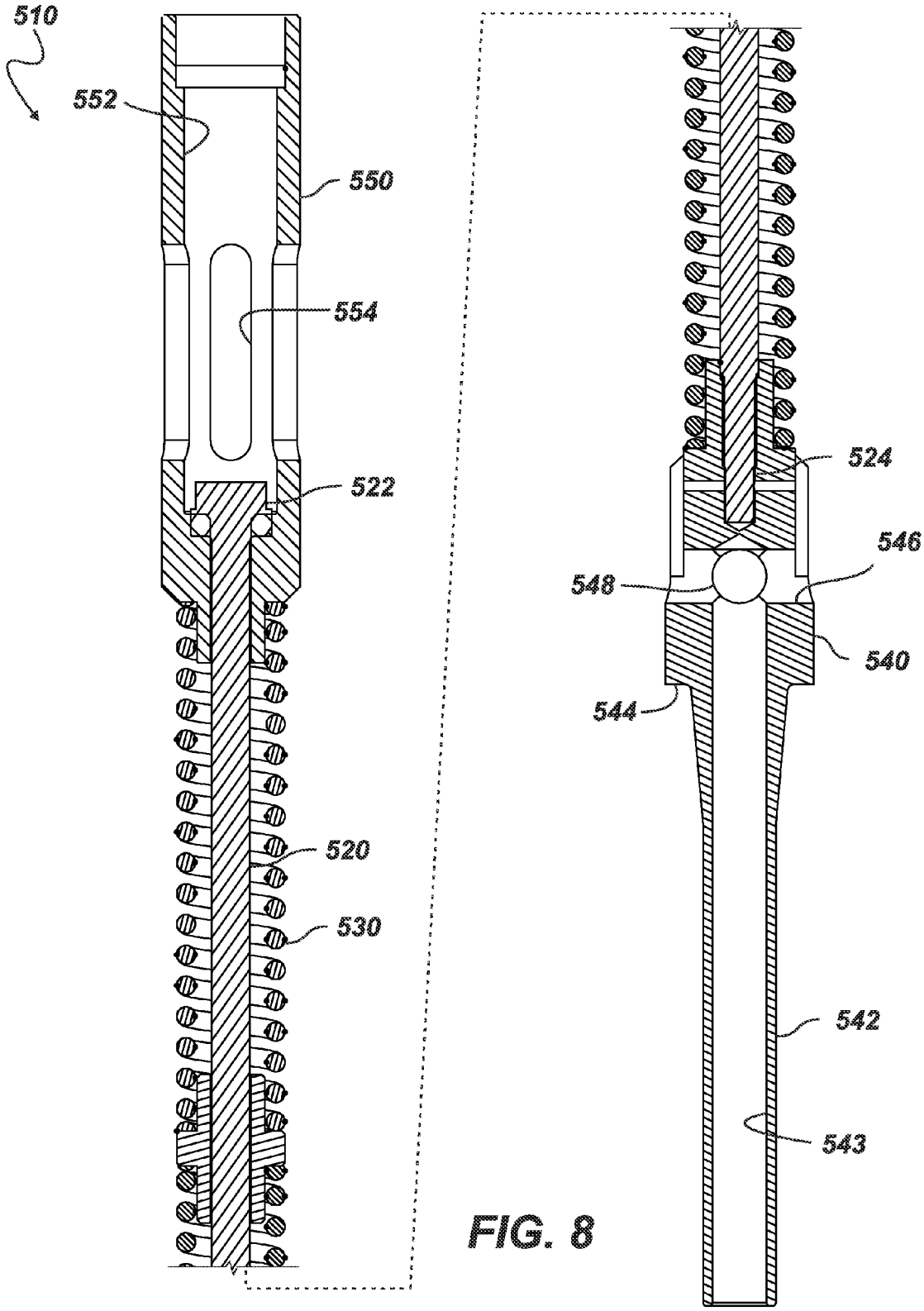
FIG. 8 illustrates a cross-sectional detail of the upper landing assembly in FIG. 5A.

The striker assembly 510 shown in more detail in FIG. 8 has a rod 520 with its lower end 524 connected to a striker body 540 and with its upper end 522 movable through a connector end 550. A double spring 530 positioned about the rod 520 biases the striker body 540 relative to the connector end 550. The striker body 540 has a shoulder 544 and a strike rod 542 with an internal bore 543. The striker's bore 543 communicates with cross ports 546 controlled by a ball valve 548 in the body 540. The connector end 550 defines an internal passage 552 communicating with side ports 554 for the passage of gas and liquid to components above the striker assembly 510.

Figure 4:
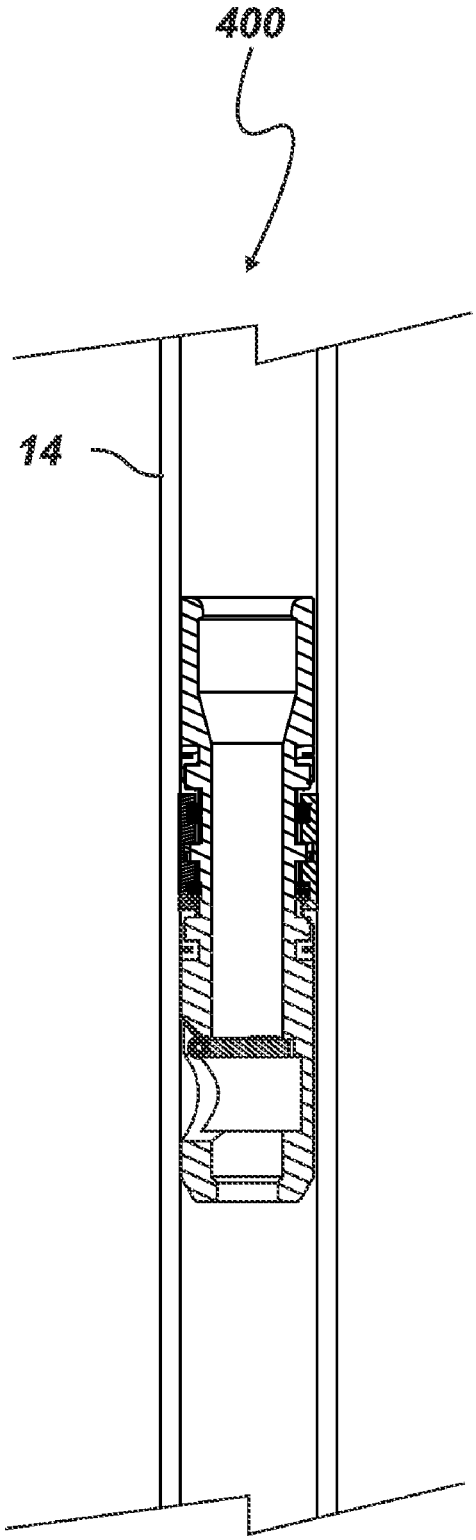
FIG. 4 illustrates a cross-sectional view of a plunger of the system in FIG. 2.

As discussed above, embodiments of the plunger 400 for the disclosed system 200 can have a hollow housing with a valve to control fluid flow through the plunger 400. One such plunger 400 is shown in FIG. 4 and in detailed cross-section in FIG. 7. The plunger 400 has a cylindrical housing 410 defining an internal passage 412 therethrough and having a valve 430 positioned in the internal passage 412. The housing's top striker end 414 strikes the striker assembly (510 in FIG. 8) when the plunger 400 is pushed up to the landing assembly (500). Likewise, the housing's lower bumper end 416 strikes the bottomhole bumper assembly (300 in FIG. 3A) when the plunger 400 drops downhole.

The outside of the plunger 400 can use pads, brushes, spiral grooves, elastomer, or other feature to produce a pressure differential across the plunger 400. In the present example, the housing 410 has a plurality of collapsible T-pads 420 disposed on the outside and biased by springs 422, although other types of pads could also be used. When positioned in tubing 14, the biased T-pads 420 engage the inside of the tubing. This creates a barrier between the annulus of the plunger 400 and the surrounding tubing 14, which can produce a pressure differential across the plunger 400 allowing gas buildup to move the plunger 400 uphole. Because the system 200 installs below the safety valve 20, the plunger 400 does not interfere with operation of tubing or wireline retrievable safety valves, and the plunger 400 only needs to travel through seal bores during installation. To allow the plunger 400 to travel through the seal bore restrictions and still lift fluid effectively in standard tubing diameters, the plunger's T-pads 420 are designed to allow the plunger 400 to be at least pushed through a safety valve and other components during initial installation. Moreover, the housing 410 is machined to drift through the nominal internal diameter of a safety valve's landing nipple used in an installation, which can be 2.750-inches in one example.

Figure 9A:
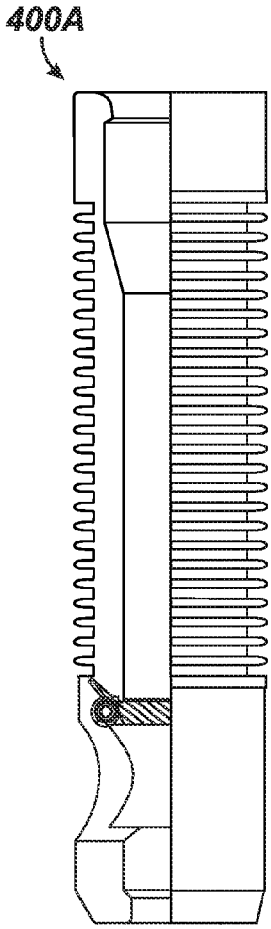
FIGS. 9A-9C illustrate alternative embodiments of the plunger in FIG. 7.
Figure 9B:
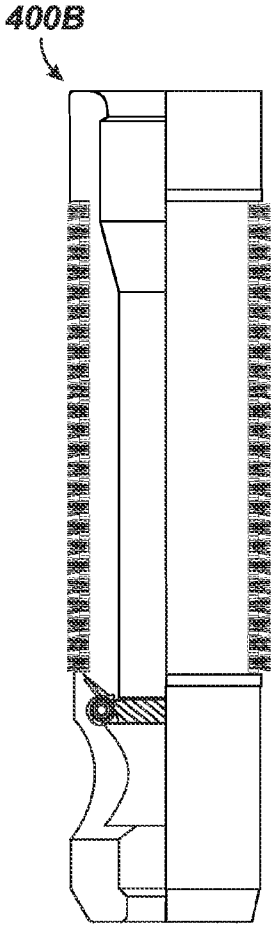
Figure 9C:
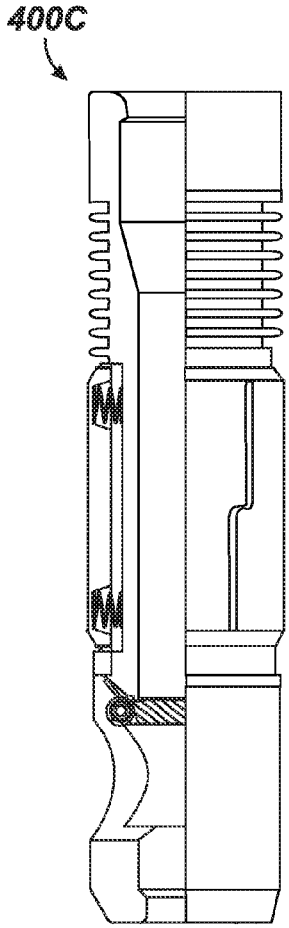

Although the present embodiment of the plunger 400 uses T-pads 420, various devices to engage the inside of the tubing and create a pressure differential across the plunger 400 can be used. For example, FIGS. 9A-9C shows embodiments of the plunger 400 having some different devices. Plunger 400A has a plurality of ribs, while plunger 400B has a plurality of fixed brushes. Plunger 400C has a combination of ribs and T-pads. These and other such devices can be used on the plunger 400.

Figure 7:
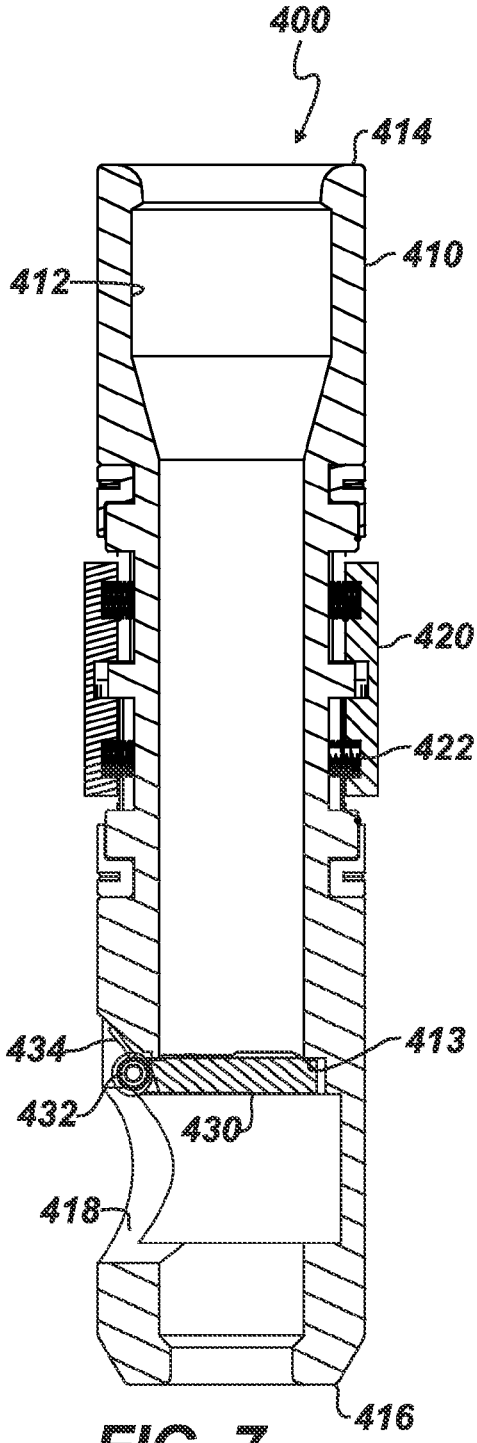
FIG. 7 illustrates a cross-sectional detail of the plunger in FIG. 4.

Within the plunger 400 of FIG. 7, the valve 430, which is a disk-shaped flap in the present embodiment, rotates on a hinge pin 432 that connects the valve 430 to the housing 410. The valve 430 allows fluid communication through the internal passage 412 when opened and positioned in a window 418 in the housing 410. When closed (as shown in FIG. 7), portion of the valve 430 engages an internal shoulder 413 of the passage 412 and blocks fluid communication through the internal passage 412. A spring 434 disposed on the pin 432 biases the valve 430 closed to block the passage 412. In this way, the valve 430 remains closed when the plunger 400 is landed on the bumper assembly 300 and when it passes through the tubing 14 pushed by gas and lifting the fluid column above it.

Figure 10A:
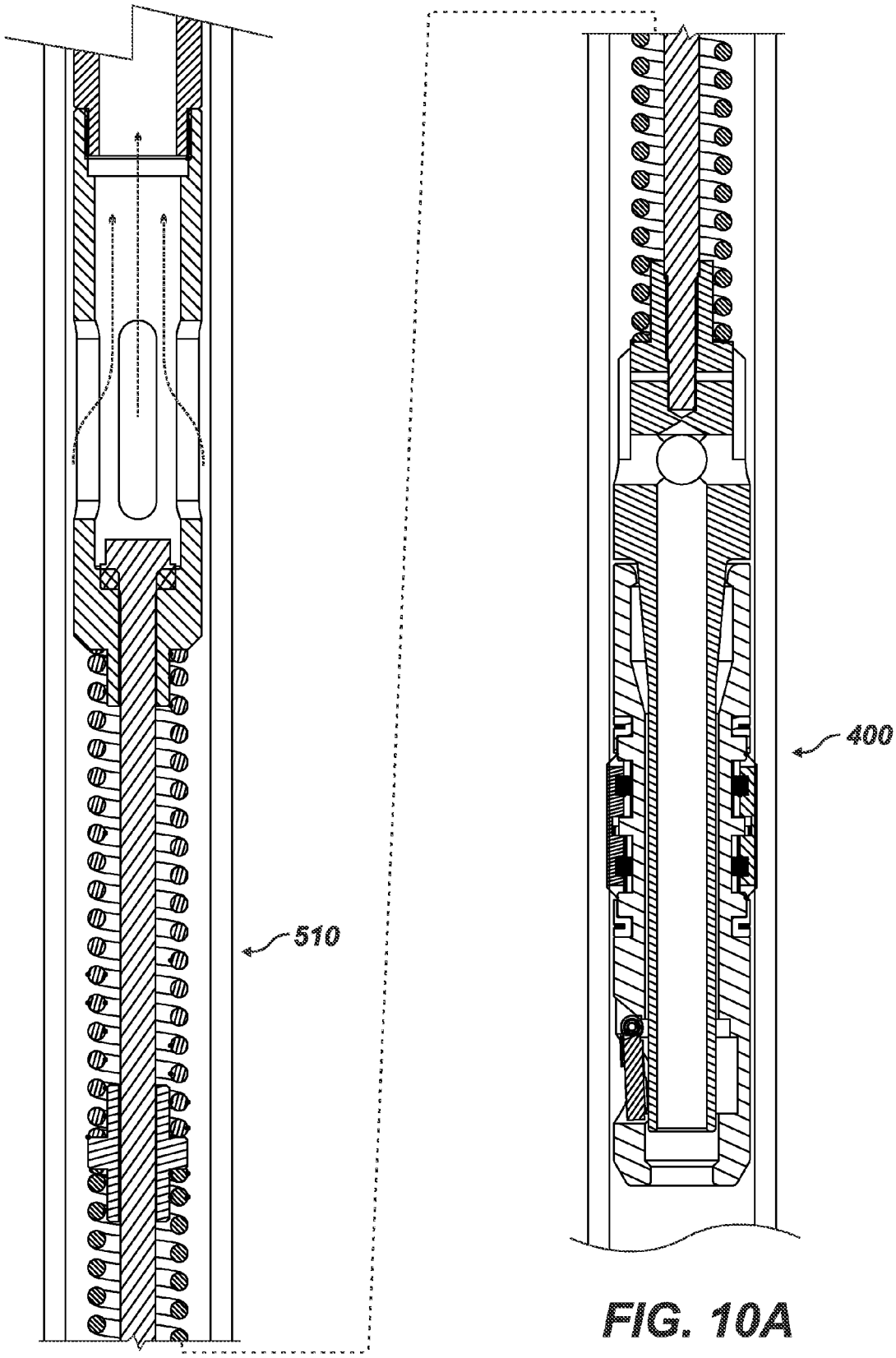
FIG. 10A illustrates a cross-sectional view of the plunger of FIG. 7 striking the landing assembly of FIG. 8.
Figure 10B:
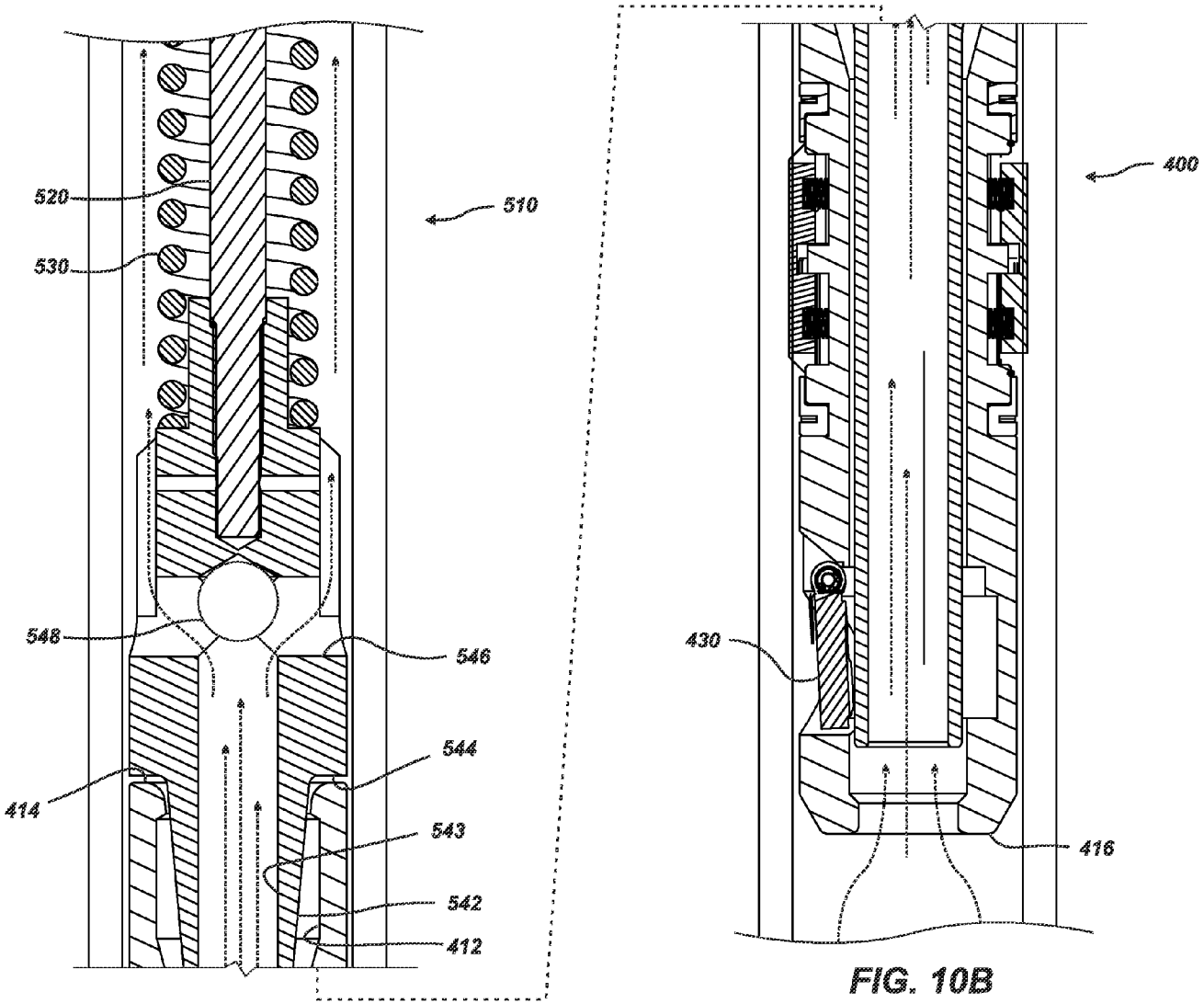
FIG. 10B illustrates a detail of FIG. 10A.

As shown in FIGS. 10A-10B, opening of the valve 430 occurs when the plunger 400 reaches the striker assembly 510 and the housing's strike end 414 engages the assembly's shoulder 544. When the plunger 400 strikes the assembly 510, the biased rod 520 and spring 530 absorb the force of the lifted plunger 400, and the strike rod 542 fits within the plunger's passage 412 and forces the valve 430 open.

While the plunger 400 remains positioned on strike rod 542 and the valve 430 remains open, the lifting gas can pass through the strike rod's passage 543, through the ball valve 548, and cross-ports 546. The fluid can then pass through the annulus between the rod/spring 520/530 and surrounding tubing 14 up to the connector end's openings (554; See FIG. 8). From the end (550), the fluid passes into upper components (not shown) coupled above the assembly 500. In such a full open condition on the rod 542, the valve 430 stays open as the fluid flow rate is great enough to keep the plunger 400 on the strike rod 542.

Initially, after the plunger's first impact, the plunger 400 may tend to repeatedly rebound from the strike rod 542 and lift again until a balance eventually occurs. When the valve reaches the strike rod 542, for example, the plunger 400 may oscillate between open and closed conditions. In the oscillation, the plunger 400 may repeatedly strike the striker assembly 510, fall away, strike again, and so on as the bumper spring 530 responds to the plunger's strikes and flow conditions allow the plunger 400 to rise and fall relative to the strike rod 542. In these circumstances, the biased valve 430, for example, closes as the plunger 400 falls off the strike rod 542 when the pressure of the lifting gas against the lower end 416 is insufficient to sustain the plunger 400 on the strike rod 542 and opens when the plunger 400 moves further up the strike rod 542. The amount and duration of such oscillation depends on the gas flow at the time and other particular details of a given implementation, such as surface area and weight of the plunger 400, bias of the spring 530, flow rates, etc. Yet, the condition of the plunger 400 stabilizes at some point and remains on the strike rod 542.

Figure 11:
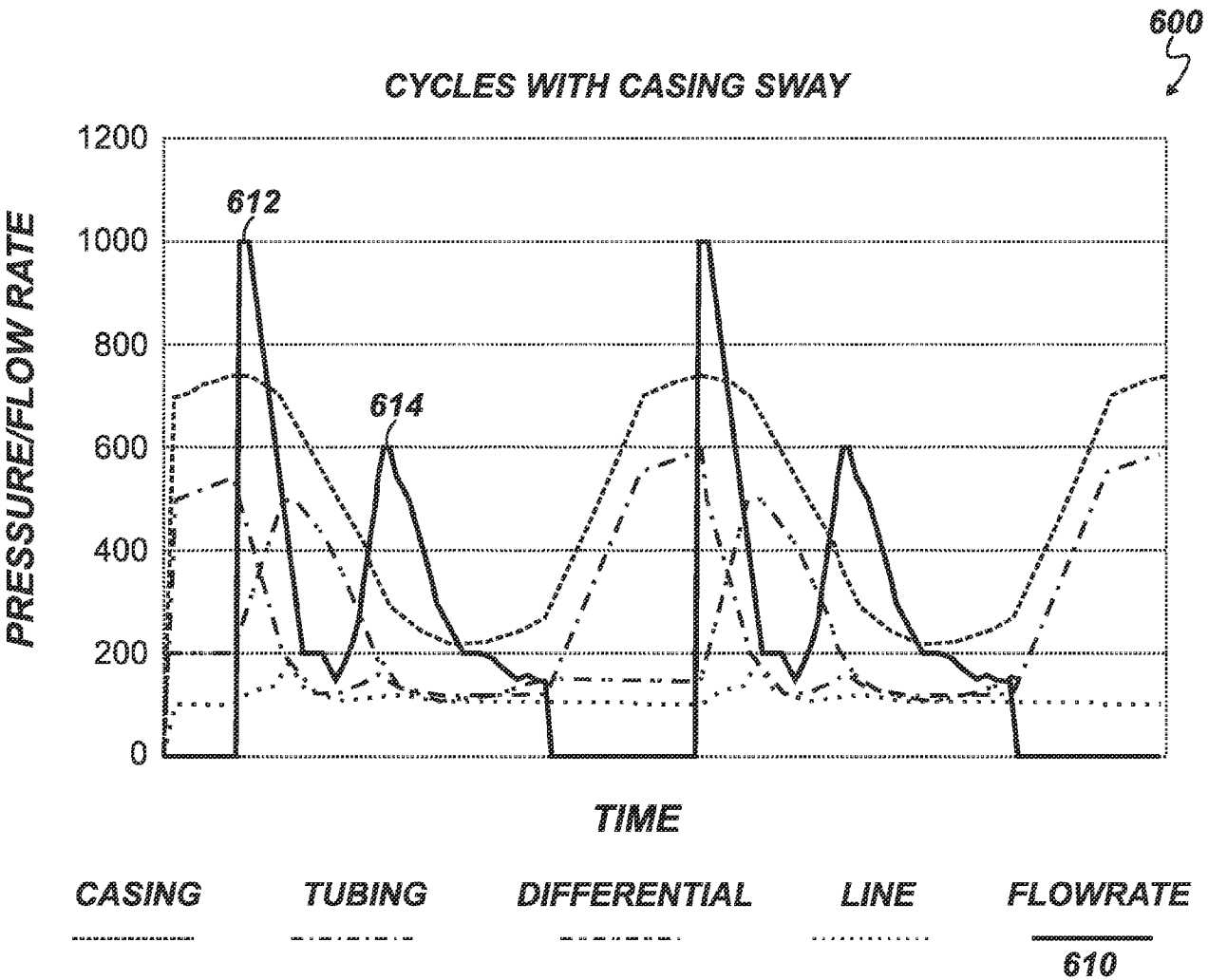
FIG. 11 illustrates a graph showing controller operation of the system of FIG. 2.

At the surface (See FIG. 2), the controller 210 uses the valve 220 and sensors 230 to control the operation of the system 200 based on measured flow. In operation, the controller 210 estimates that the plunger 400 has arrived at the landing assembly 500 based on measured flow conditions for the plunger's cycle. For example, FIG. 11 illustrates a graph showing an example of the plunger cycle 600. In the cycle 600, the flow rate 610 has an initial peak 612 followed by a subsequent peak 612 upon arrival of the plunger 400, later followed by a drop off. The controller 210 is configured identify the two peaks 612 and 614 and to use the second flow peak 614 as an estimate of the plunger 400's arrival at the upper landing assembly 500.

Based on the estimated arrival from the peaks, the controller 210 then operates its valve 220 to control flow to the sale line 150 at the surface. After flow has stabilized and the buildup of gas that lifted the plunger 400 has been diverted to the sales line 150, the controller 210 eventually shuts-in the well by closing the valve 220. As a result, the plunger 400 drops away from strike rod 542 due to decreased flow to keep the plunger 400 on the strike rod 542 and its valve 430 closes. As a consequence, the plunger 400 drops to the lower bumper assembly 300 for another cycle.

Figure 12A:
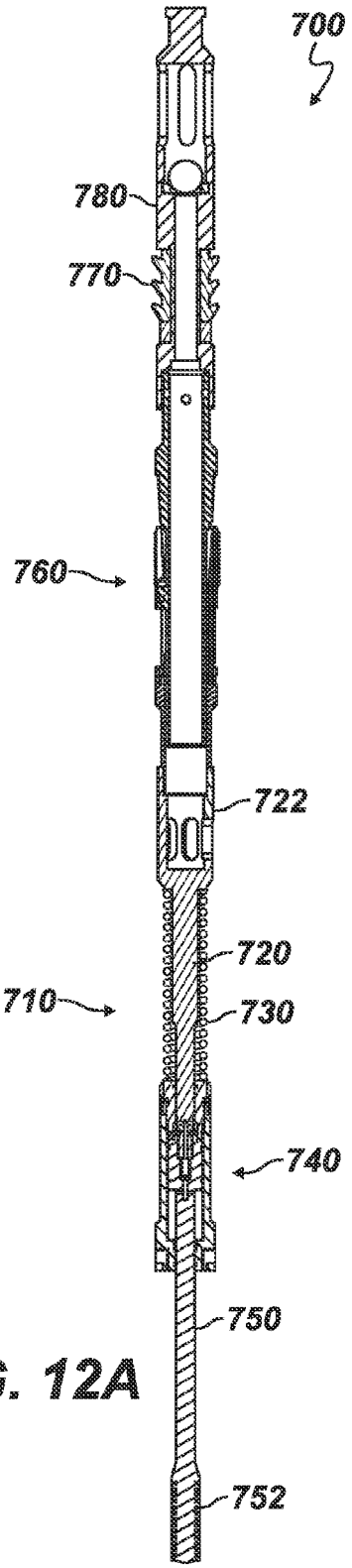
FIGS. 12A-12B illustrate cross-sectional views of another upper landing assembly according to the present disclosure.

Another embodiment of a plunger lift system also has a lower assembly (e.g., 300 in FIG. 3), an upper landing assembly 700 (FIGS. 12A-12B), and a plunger 800 (FIG. 13), each of which position below the safety valve in the tubing. The downhole bumper assembly used in this embodiment can be the same as that discussed previously with reference to FIGS. 3A-3B. The upper landing assembly 700 shown in FIGS. 12A-12B installs directly below the safety valve using wireline procedures. As shown in FIG. 12A, the landing assembly 700 has a striker assembly 710, a tubing stop 760, a swab cup/sealing element 770, and a vent sub-assembly 780 with ball seal.

Figure 12B:
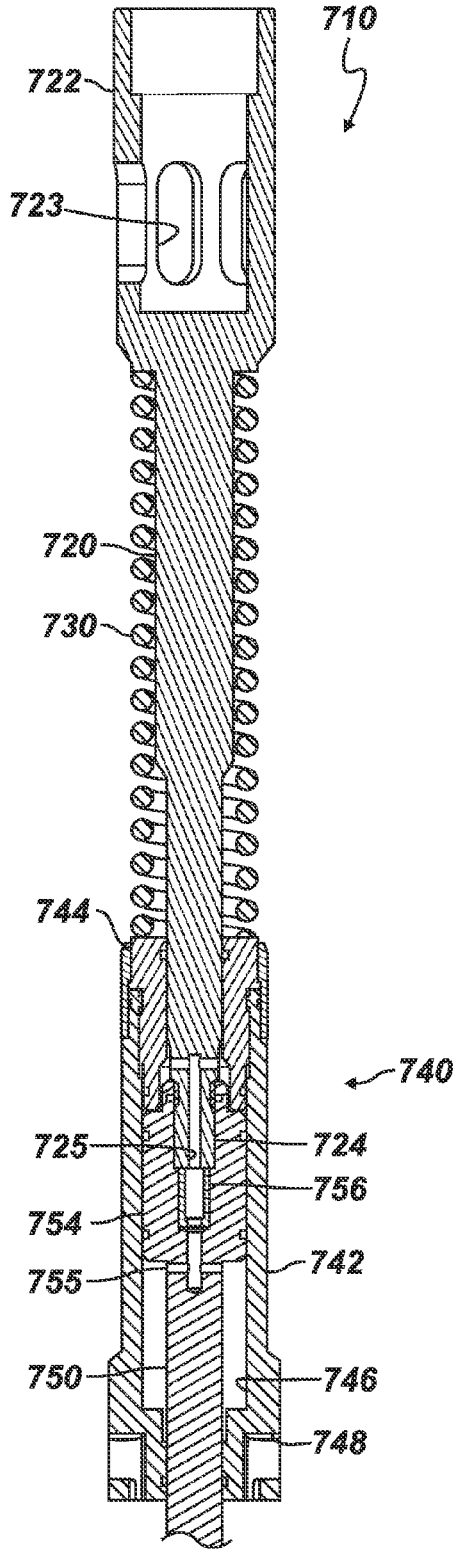

The striker assembly 710 shown in FIGS. 12A-12B has a rod 720 having a connector end 722 vented with openings 723 and having a distal end connected to a striker rod 750. A recoil assembly 740 positions at the connection of the rods 720/750, and a spring 730 on rod 720 biases a housing 742 of the recoil assembly 740.

The plunger 800 shown in detailed cross-sections in FIGS. 13-16 has a cylindrical housing 810, collapsible T-pads 820, and a valve 830. Many of the plunger's features, such as the housing 810 and T-pads 820, are similar to those discussed with reference to the embodiment in FIG. 7 and are not repeated here.

Figure 13:
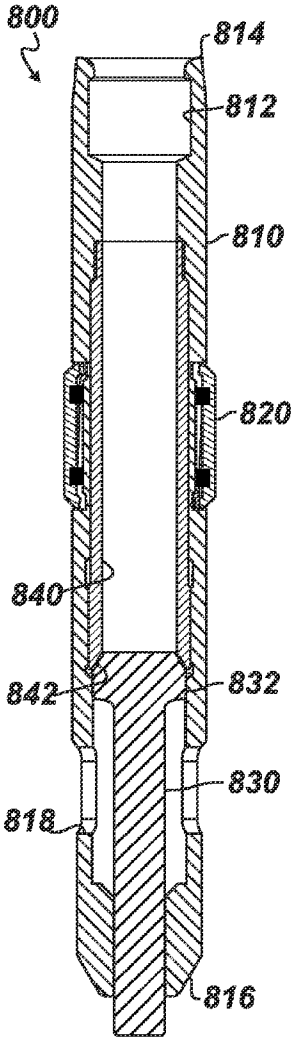
FIG. 13 illustrates a cross-sectional view of a plunger according to the present disclosure having a piston valve.

In the embodiment of FIG. 13, the plunger's valve 830 is a piston movable though an opening in the plunger's distal end 816. A head 832 on the piston 830 is movable within the housing's internal bore 812 relative to side openings 818 to open and close communication through the housing 810. In the valve's closed condition (shown in FIG. 13), for example, the head 832 engages an internal shoulder 842, which can be part of an internal sleeve 840, and restricts fluid communication into the plunger's internal passage 812. In the open condition of the valve 830 (shown in FIG. 15), the head 832 permits fluid communication through the openings 818 and into the plunger's internal passage 812.

Figure 15:
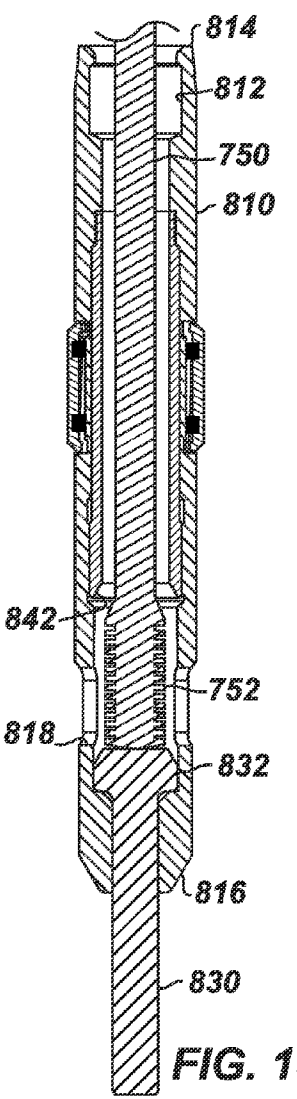
FIG. 15 illustrates a cross-sectional view of the plunger of FIG. 13 striking the strike rod of the assembly in FIGS. 12A-12B.

During use, downhole pressure moving the plunger 800 uphole pushes against the piston 830's distal end and moves it to the closed condition (e.g., FIG. 13). Likewise, as shown in FIG. 15, engagement with the landing assembly's strike rod 750 moves the piston 830 to the open position to allow fluid flow through side openings 818 and up the annulus between rod 750 and internal bore 812.

Once it has struck the rod 750, the plunger 800 can remain engaged on the rod 750 as long as fluid pressure is sufficient against the plunger's distal end (i.e., as long as gas flow is high enough and the controller maintains the valve open at the wellhead). As with the previous plunger embodiment, the plunger 800 may tend to oscillate on the end of the strike rod 750 depending on the fluid pressure, amount of rebound, surface area, etc. To help maintain the plunger 800 on the rod 750, the rod's distal end 752 defines a series of circumferential grooves to disrupt flow through the side openings 818 adjacent to the end 752. This flow disruption may tend to reduce fluid pressure within this region and to help "catch" the plunger 800 on the rod's end 752.

Figure 14:
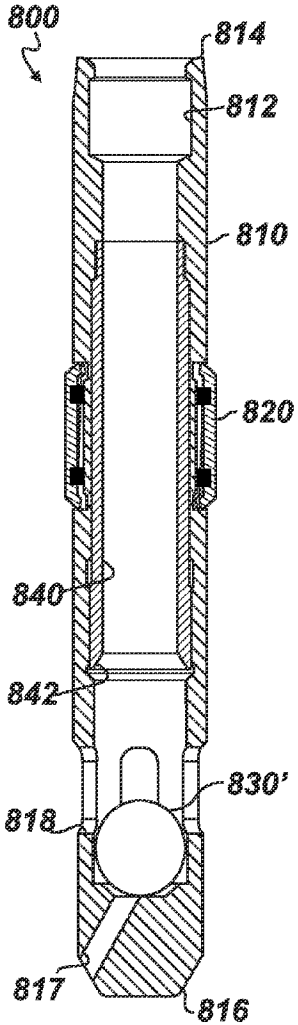
FIG. 14 illustrates a cross-sectional view of a plunger according to the present disclosure having a ball valve.

In an alternative shown in FIG. 14, the plunger's valve can include a ball valve 830' movable in the plunger's internal passage 812 relative to side openings 818 and shoulder 842. Upwards pressure moves the ball valve 830' against shoulder 842 to block flow through the plunger 800, which would allow gas to lift the plunger 800 and any fluid column above it in the tubing. To allow such upward pressure to be applied against the ball valve 830 while the plunger is on the bottomhole bumper, the housing 810 can define a port 817 communicating the internal passage 812 below the valve 830'. Like the previous embodiments, the striker rod 750 can engage the ball valve 830' away from the shoulder 842 when the plunger 800 reaches the landing to allow flow through the plunger.

Figure 16:
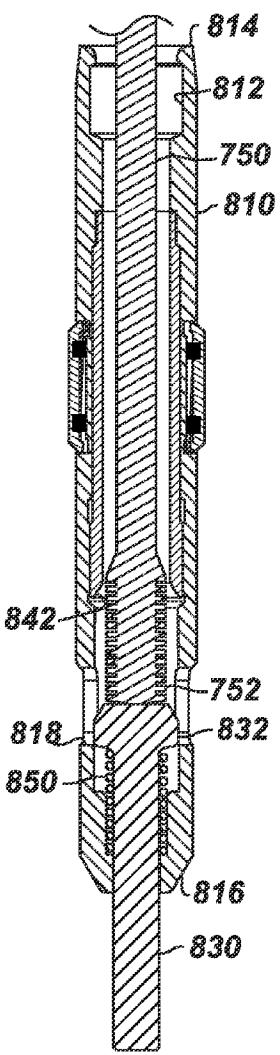
FIG. 16 illustrates a cross-sectional view of the plunger of FIG. 13 having a spring.

In another alternative shown in FIG. 16, the previously described piston valve 830 can be biased by a spring 850 to the closed condition. This spring 850 acts to maintain the piston 830 in the closed condition blocking openings 818 and may help to maintain the plunger 800 on the rod's end 752. For example, should the plunger 800 drop from the rod's end 752, the spring 850 closes the piston 830, tending to then force the plunger 800 back onto the rod's end 752.

Figure 17A:
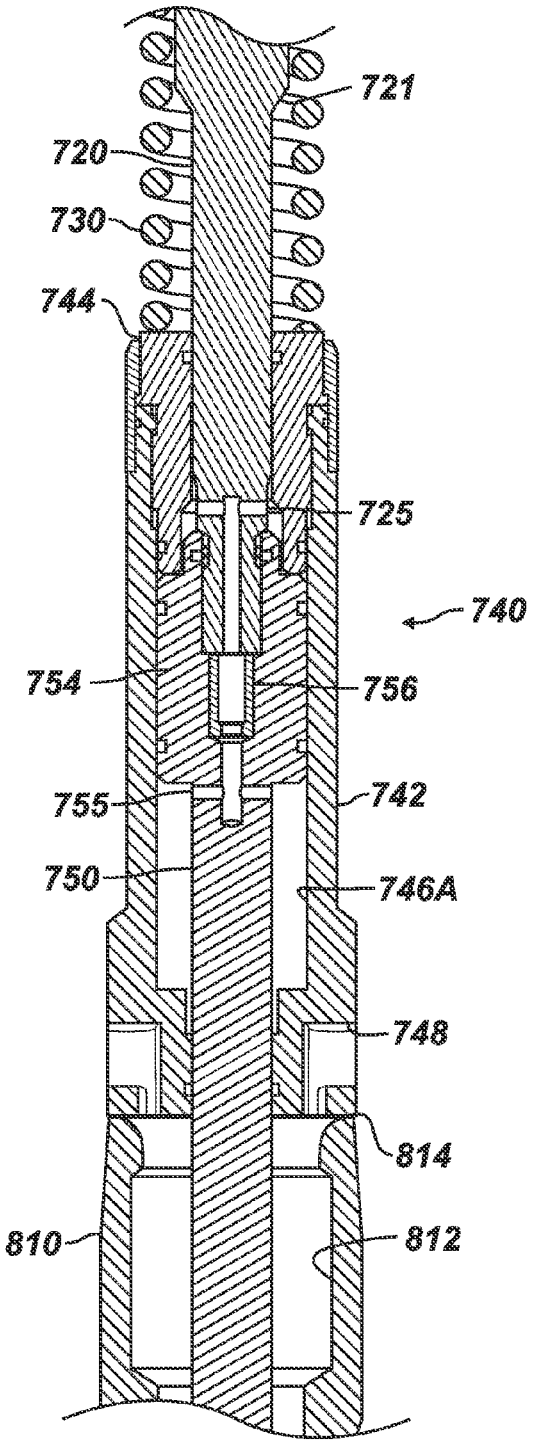
FIGS. 17A-17B illustrate cross-sectional details of the recoil system for the striker assembly of FIGS. 12A-12B.
Figure 17B:
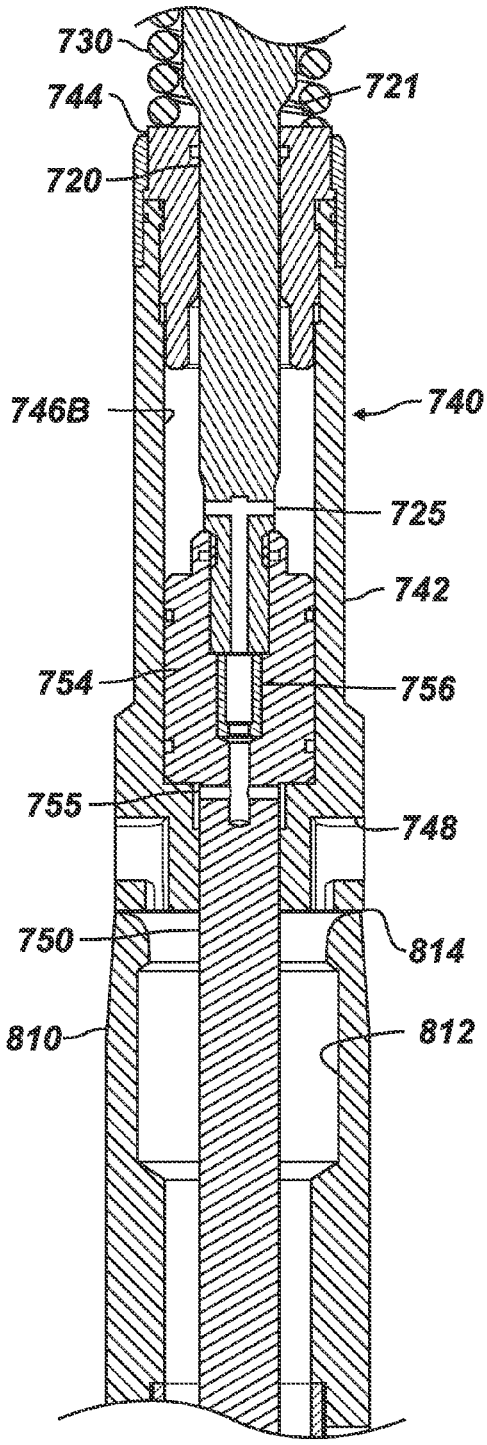

As shown in detailed cross-section in FIGS. 17A-17B, the plunger 800 when pushed uphole engages the landing assembly 710, and the spring 730 and recoil system 740 braces the impact of the plunger 800 and its valve 830 on the striker assembly 710. As shown in FIG. 17A, the plunger's striker end 814 engages the bottom of the recoil housing 742 as the fluid column above the plunger 800 has passed through the annulus between the housing 742 and surrounding tubing (not shown). Upon impact, the plunger's internal passage 812 communicates with the housing's distal ports 748 and allows fluid to pass from the plunger's passage 812, through ports 748, and between the annulus of the housing 742 and tubing.

At impact, the bias of spring 730 against the housing's end cap 744 as well as by hydraulic fluid in the housing's chamber 746 absorbs the plunger's energy. Specifically, the plunger's impact moves the housing 742, which is resisted by the spring 730's bias. In addition, hydraulic fluid contained in the lower chamber portion 746A (FIG. 17A) passes through a conduit 755 in the striker rod's proximate end 754 and passes into the upper chamber portion 746B via a complementary conduit 725 in the assembly's rod 720. As the spring 730 is compressed, a one-way restrictor 756 between the conduits 725 and 755 allows fluid to flow from the lower chamber portion 746A to the upper chamber portion 746B. This restricted passage of the hydraulic fluid may also absorb some of the plunger's impact against housing 742.

After full impact of the plunger's end 814, the housing 742 may have the position on rod 750 as shown in FIG. 17B closer to a shoulder 721 on the rod 720. At this stage, produced fluid keeping the plunger 800 engaged on the assembly 710 can now pass through the plunger 800 and though distal ports 748 to be produced further uphole. Additional side ports (not shown) ma be provided in the housing of the plunger 800 to permit flow from the internal passage 812. With the valve 830 of the plunger 800 opened by the striker rod 750, fluid flow tends to cause the plunger to "float" until flow is stopped by closure of the sales valve at the surface.

When pressure stabilizes, the spring 730 attempts to push the recoil housing 742 along with the plunger 800 downward, which would allow the plunger's valve 830 to eventually close. Although the spring 730 absorbs impact, it may also recoil too quickly and force the plunger 800 away from the striker rod 750. However, the hydraulic fluid in chamber 746 tends to prevent rapid recoil by instead requiring hydraulic fluid to return from the upper chamber portion 746B to the lower chamber portion 746A via conduits 725 and 755 and the one-way restrictor 756. As the spring 730 extends, for example, the one-way restrictor 756 between conduits 725 and 755 reduces the hydraulic fluid's return flow and inhibits the extension of the spring 730, thereby reducing the recoil caused by the spring 730.

Although the material used for the components of the disclosed plunger systems may depend on characteristics of a particular implementation, the materials are preferably of a greater or equal quality to that of the tubing material. For example, a 13Cr material may be used for standard metal components, and nickel based alloys are preferably used for components requiring high-strength, high impact material. Dynamic seals for the components are preferably T-Seals, and the static seals can be elostomer O-rings. The various springs of the system are preferably composed of Inconel X-750. The materials can be brushed by stainless steel banding with Inconel X-750 retaining wire and PEEK bristles. The pin 432 of the plunger's valve 430 in FIG. 7 is preferably composed of MP35N® alloy [UNS R30035] (trademark of SPS Technologies, Inc.) with a yield strength of at least about 235 ksi, as opposed to being composed of stainless steel.

The foregoing description of preferred and other embodiments is not intended to limit or restrict the scope or applicability of the inventive concepts conceived of by the Applicants. Accordingly, features of the plunger lift system disclosed in one embodiment can be applied to other embodiments disclosed herein. For example, the recoil assembly of FIGS. 17A-17B can be used not only for the striker assembly of FIGS. 12A-12B but also for the striker assembly of FIG. 8. Furthermore, although embodiment of the disclosed plunger lift system have been described as having the plunger movable within the tubing only below the safety valve, it will be appreciated with the benefit of the present disclosure that the components of the system can be used in implementations where the plunger passes through a safety valve during the plunger cycle. Moreover, it will be appreciated with the benefit of the present disclosure that the disclosed plunger having the valve can also be used in conventional system having a lubricator/catcher at the surface.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A gas lift plunger, comprising:

a housing being movable within tubing of a well and defining a flow passage therethrough; and a valve disposed on the housing and being movable to open and closed positions relative to the flow passage, the valve engageable with an uphole element and being movable thereby to the open position, the valve in the open position permitting fluid communication through the flow passage, the valve in the closed position preventing fluid communication through the flow passage, the plunger being movable uphole by application of downhole pressure and lifting a fluid column above the plunger when moved uphole, wherein the valve comprises a flapper hingedly connected to the housing and movable on the hinged connection between the open and closed positions, the flapper in the closed position engaging a shoulder defined in the flow passage of the housing.

2. The plunger of claim 1, wherein the valve comprises a spring biasing the valve to the closed position.

3. The plunger of claim 1, wherein the housing comprises means for producing a pressure differential across the plunger.

4. The plunger of claim 1, further comprising a landing as the uphole element disposing in the tubing below a safety valve in the well, the landing engaging the plunger when lifted to the landing and preventing the plunger from passing through the safety valve.

5. The plunger of claim 4, wherein the landing comprises a striker rod moving the valve of the plunger to the open position when engaged therewith.

6. The plunger of claim 5, wherein the strike rod has an internal passage permitting fluid communication through at least a portion of the landing.

7. A gas lift apparatus, comprising:

a housing defining a fluid passage therethrough and being movable within tubing of a well, the housing being movable uphole by application of downhole pressure and lifting a fluid column above the housing when moved uphole;

means for selectively allowing fluid communication through the fluid passage in the housing; and means disposed in the tubing below a safety valve for engaging uphole movement of the housing, the uphole engaging means actuating the means for selectively allowing fluid communication through the fluid passage in the housing.

8. The apparatus of claim 7, wherein the housing comprises means for producing a pressure differential across the housing.

9. The apparatus of claim 7, wherein the uphole engaging means comprises means for absorbing uphole movement of the housing.

10. The apparatus of claim 9, wherein the absorbing means comprises means for reducing recoil when absorbing the uphole movement of the housing.

11. The apparatus of claim 7, wherein the uphole engaging means comprises:

means for permitting uphole flow therethrough, and means for preventing downhole flow therethrough.

12. The apparatus of claim 6, further comprising means disposed in the tubing below a safety valve for engaging downhole movement of the housing.

13. A plunger lift system, comprising:

a plunger movably disposed in tubing of a well, the plunger lifting a fluid column above the plunger when lifted by application of downhole pressure; and a landing positioned in the tubing below a safety valve in the well, the landing engaging the plunger when lifted to the landing and preventing the plunger from passing through the safety valve.

14. The system of claim 13, wherein the plunger comprises means for producing a pressure differential across the plunger.

15. The system of claim 13, wherein the plunger comprising a body being solid or semi-hollow.

16. The system of claim 13, wherein the plunger comprises a housing having a flow passage therethrough and having a valve movably positioned relative to the flow passage, the valve of the plunger controlling fluid flow through the flow passage.

17. The system of claim 16, wherein the landing has a striker rod, and wherein the valve of the plunger is movable to open and closed positions relative to the flow passage, the valve of the plunger engageable with the striker rod and being movable thereby to the open position, the valve of the plunger in the open position permitting fluid communication through the flow passage, the valve of the plunger in the closed position preventing fluid communication through the flow passage.

18. The system of claim 16, wherein the valve of the plunger comprises a flapper hingedly connected to the housing and movable between open and closed positions relative to the flow passage.

19. The system of claim 16, wherein the valve of the plunger comprises a piston movable between open and closed positions in the hollow housing.

20. The system of claim 13, further comprising:

a bumper positioned in the tubing below the landing and engaging downhole movement of the plunger in the tubing.

21. The system of claim 13, wherein the landing has a strike rod having an internal passage, the strike rod permitting fluid communication through at least a portion of the landing.

22. The system of claim 13, wherein the landing comprises a spring biasing engagement of the plunger with the landing.

23. The system of claim 13, wherein the landing comprises a hydraulic chamber having a first end engageable with the plunger and having a second end biased by a spring, the hydraulic chamber permitting hydraulic flow from a first portion of the chamber to a second portion of the chamber in response to engagement of the plunger with the first end and restricting fluid flow from the second portion to the first portion in response to bias of the spring.

24. The system of claim 13, further comprising a controller estimating engagement of the plunger with the landing based on flow measurements.

25. The system of claim 24, wherein the controller couples to a flow valve and controls fluid communication through the tubing in response to the estimated engagement.

26. A well gas lift method, comprising:

disposing a plunger in tubing of a well;

disposing a landing below a safety valve in the tubing;

permitting uphole movement of the plunger by application of downhole pressure;

lifting fluid above the plunger with the uphole movement; and preventing passage of the plunger through the safety valve by engaging the plunger on the landing below the safety valve.

27. The method of claim 26, wherein engaging the plunger on the landing comprises absorbing impact of the plunger on the landing.

28. The method of claim 27, wherein absorbing the impact comprises reducing recoil from the absorbed impact.

29. The method of claim 26, wherein permitting the uphole movement of the plunger by application of downhole pressure comprises biasing a valve on the plunger closed.

30. The method of claim 26, further comprising at least temporarily permitting fluid flow past the plunger when engaged on the landing.

31. The method of claim 30, wherein at least temporarily permitting fluid flow past the plunger comprises:

opening a valve of the plunger when engaged with the landing; and allowing fluid flow through a fluid passage in the housing.

* * * * *